United States Patent [19]

Nishida et al.

[11] Patent Number: 4,727,840

[45] Date of Patent: Mar. 1, 1988

[54] THROTTLE VALVE CONTROL DEVICE

[75] Inventors: Minoru Nishida; Hideaki Katashiba, both of Hyogo, Japan

[73] Assignee: Mitsubishi Denki Kabushiki Kaisha, Tokyo, Japan

[21] Appl. No.: 34,974

[22] Filed: Apr. 6, 1987

[30] Foreign Application Priority Data

Apr. 4, 1986 [JP] Japan ..... 61-78764

[51] Int. Cl.[4] ..... F02D 9/08

[52] U.S. Cl. ..... 123/399; 123/361

[58] Field of Search ..... 123/361, 376, 398, 400, 123/403

[56] References Cited

U.S. PATENT DOCUMENTS

| | | | |
|---|---|---|---|
| 2,594,739 | 4/1952 | Davis | 180/171 |
| 2,978,059 | 4/1961 | Miller | 123/337 |
| 3,099,330 | 7/1963 | Von Berg et al. | 123/378 |
| 3,575,257 | 4/1971 | Wojcikowski | 123/376 |
| 4,304,202 | 12/1981 | Schofield | 123/376 |
| 4,401,077 | 8/1983 | Earl | 123/403 |
| 4,424,781 | 1/1984 | Speer et al. | 123/403 |
| 4,462,357 | 7/1984 | Lockhart | 123/361 |

*Primary Examiner*—William A. Cuchlinski, Jr.
*Attorney, Agent, or Firm*—Sughrue, Mion, Zinn, Macpeak, and Seas

[57] ABSTRACT

A throttle valve control device comprises: a valve shaft for operating a throttle valve; a differential gear device having first and second drive gears, for driving the valve shaft; first and second electronic control actuators for rotating the first and second drive gear, respectively; and a sensor for detecting the degree of opening of the throttle valve, so that the operation of the throttle valve is controlled by the electronic control actuators while the degree of opening of the throttle valve is being detected.

2 Claims, 1 Drawing Figure

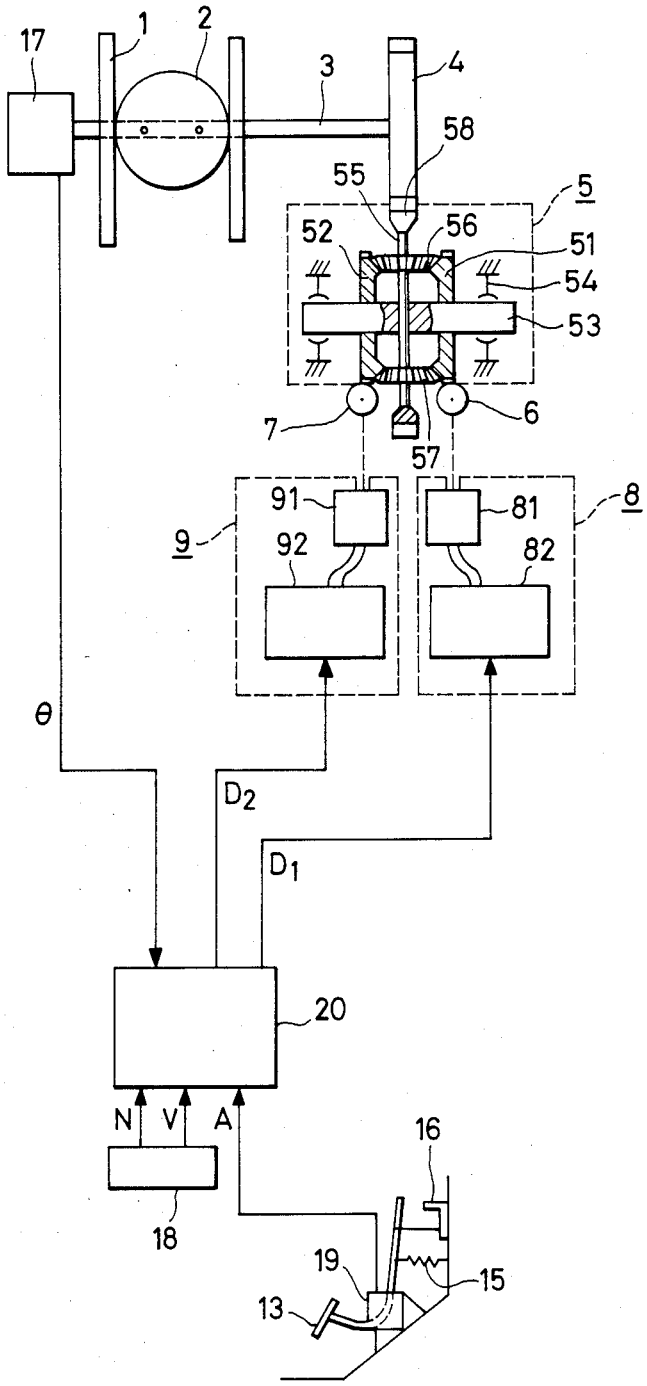
17
1
2
3
4
58
55
5
52
56
51
54
53
7
6
57
91
81
8
9
92
82
θ
D2
D1
20
N
V
A
16
18
19
15
13

THROTTLE VALVE CONTROL DEVICE

BACKGROUND OF THE INVENTION

This invention relates to a throttle valve control device for a vehicle engine.

A throttle valve control device is being developed as part of the engine control for improving the exhaust gas purifying performance and the economical use of fuel of an engine. In the throttle valve control device, the mechanical connection between the throttle valve and the acceleration pedal is eliminated, and instead an electronic control actuator is employed which controls the operation (opening and closing) of the throttle valve in response to both an electrical signal which is obtained by converting the amount of movement of the accelerating pedal (hereinafter referred to as "an accelerating-pedal movement signal", when applicable) and signals (such as an engine speed signal and a gear position signal) representing other engine operating conditions or vehicle running speeds.

In the conventional throttle valve control device with the electronic control actuator, the operation of the throttle valve is controlled by the drive motor which is operated in response to instructions signals from a vehicle controller, which comprises an arithmetic and control circuit adapted to calculate a most suitable degree of opening for the throttle valve according to the signals representing engine operating conditions and vehicle running conditions. Therefore, the device should be equipped with security means for preventing the occurrence of a difficulty that the operation of the vehicle becomes out of control when the electronic control actuator becomes out of order during traveling of the vehicle.

The following examples of the security means have been disclosed by Japanese Patent Application (OPI) No. 145867/1980 (the term "OPI" as used herein means "an unexamined published application"):

(1) In the first example, a return spring for returning the throttle valve to the closing position when the control is stopped is provided for the throttle shaft.

(2) In the second example, an electromagnetic clutch is provided to disconnect the throttle shaft from the electronic control actuator when the latter does not work.

(3) In the third example, the return spring and the electromagnetic clutch are combined together in such a manner that the return spring is operated in response to the disconnection of the electromagnetic clutch.

However, the above-described conventional throttle valve control device suffers from a drawback that, when the electronic control actuator becomes out of order, the above-described difficulty that the operation of the vehicle becomes out of order can be prevented; however, the vehicle cannot be run away any longer, so that the vehicle cannot be moved to a certain place for repair for instance.

SUMMARY OF THE INVENTION

Accordingly, an object of this invention is to provide a throttle valve control device in which the above-described drawback accompanying a conventional throttle valve control device has been eliminated, and which is high both in reliability and in responsibility.

The foregoing object and other objects of the invention have been achieved by the provision of a throttle valve control device which, according to the invention, comprises: a valve shaft for operating a throttle valve adapted to vary the output of an engine; a differential gear device for driving the valve shaft, the differential gear device having first and second drive gears; first and second electronic control actuators for rotating the first and second drive gears of the differential gear device, respectively; and an opening degree sensor for detecting a degree of opening of the throttle valve.

The nature, principle and utility of the invention will become more apparent from the following detailed description when read in conjunction with the accompanying drawing.

BRIEF DESCRIPTION OF THE DRAWINGS

In the accompanying drawings, the single FIGURE is an explanatory diagram, partly as a block diagram, showing the arrangement of one example of a throttle valve control device according to this invention.

DETAILED DESCRIPTION OF THE PREFERRED EMBODIMENT

One example of a throttle valve control device according to this invention will be described with reference to the signal figure in the accompanying drawing.

In the figure, reference numeral 1 designates an air intake pipe of an engine (not shown); 2, a throttle valve; 3, a valve shaft for operating the throttle valve; 4, a gear mounted on the valve shaft 3; and 5, a differential gear device.

In the differential gear device 5, bevel gears 51 and 52 are rotatably mounted on a shaft 53, and are engaged with first and second drive gear 6 and 7, respectively. The shaft 53 is supported by bearings 54, and a pinion shaft 55 is secured to the shaft 53 in such a manner that the pinion shaft 55 is perpendicular to the shaft 53. Small bevel gears 56 and 57 are mounted on the pinion shaft 55, and engaged with the bevel gears 51 and 52. Both ends of the pinion shaft 55 are secured to a large gear 58 which rotates the valve shaft 3 of the throttle valve 2 through the gear 4.

The first and second drive gears 6 and 7 are worms, and the cylindrical outer walls of the bevel gears 51 and 52 are formed into worm wheels.

The throttle valve control device of the invention further comprises electronic control actuators 8 and 9. The electronic control actuator 8 is made up of a DC drive motor 81 and a current control circuit 82 for supplying current to the motor 81. Similarly, the electronic control actuator 9 is made up of a DC drive motor 91 and a current control circuit 92 for supplying current to the motor 91. The worms 6 and 7 are rotated by the output shafts of the drive motors 81 and 91, respectively.

Further in the figure, reference numeral 17 designates an opening-degree sensor made up of a potentiometer or the like for detecting a degree of opening of the throttle valve 2, and 20, an arithmetic and control section. The arithmetic and control section 20 receives the output signals of a sensor 18 for detecting an engine operating condition (such as an engine speed N) and a vehicle running condition (such as a vehicle speed V) and the output signal of another sensor 19 for detecting the amount of movement of an accelerating pedal 13, and performs predetermined arithmetic operation using the signals to output a target degree of opening $\theta_t$ (hereinafter referred to as "a target opening degree $\theta_t$" when applicable) for the throttle valve 2, and compares it with the output signal $\theta$ of the opening degree sensor 17, and applies rotation instruction signals $D_1$ and $D_2$ to the electronic control actuators 8 and 9 according to the difference between the two values $\theta_t$ and $\theta$.

Further in the figure, reference numeral 15 designates a return spring provided for the accelerating pedal 13, and 16, a stopper for the accelerating pedal 13.

The operation of the throttle valve control device thus organized will be described.

The torques of the electronic control actuators 8 and 9 are transmitted through the worms 6 and 7 and the worm wheels to the bevel gears 51 and 52, respectively. As a result, with the aid of the small bevel gears 56 and 57 the torques of the electronic control actuators act differentially on the pinion shaft 55 to turn the latter 55 around the shaft 53. The torque of the pinion shaft 55 is transmitted through the large gear 58 to the gear 4 of the throttle valve shaft 3. Therefore, when the drive motors 81 and 91 are so driven that the large bevel gears 51 and 52 are rotated in the same direction, the sums of the drive forces and the speeds of rotation of the gears rotate the throttle valve shaft 3; whereas when the drive motors are so driven that the gears are rotated in opposite directions, the difference between those of the gears rotate the throttle valve shaft 3.

It is assumed that the speeds of rotation of the large bevel gears 51 and 52 are represented by $n_1$ and $n_2$ (including the directions of rotation), respectively (for instance, the clockwise direction as viewed from right in the figure is "positive", and the counterclockwise direction "negative"), and the speed of rotation of the pinion shaft 55 $n_0$. Then, when the bevel gears are equal to each other in the number of teeth, a relation of $n_0=(n_1+n_2)/2$ is established.

In the above-described throttle valve control device, the rotation of the drive motors 81 and 91 are transmitted to the differential gear 5 by means of the worms and the worm wheels. However, the worms and the worm wheels may be replaced by a gear train having a sufficiently high reduction gear ratio with improved efficiency. In this case, the reduction gear ratio should be such that the output shafts of the drive motors are not driven by a drive force from the differential gear device side whether or not the drive motors 81 and 91 are in operation.

For the drive section operating as described above, the arithmetic and control section 20 calculates the target opening degree $\theta_i$, for instance, according to the following expression by using the output A of the sensor 19 (hereinafter referred to as "an acceleration opening degree A", when applicable), the engine speed N, and the vehicle speed V:

$$\theta_i=A(1+k(V/50-1)N)$$

where k is the coefficient which is determined for each vehicle so that the operator can smoothly operate the vehicle.

As is apparent from the above expression, the target opening degree $\theta_i$ of the throttle valve 2 becomes larger than the acceleration opening degree A when the vehicle speed V is higher than 50 Km/h and as the engine speed N increases. Therefore, when the vehicle is run at high speed, acceleration of the vehicle can be achieved smoothly. On the other hand, when the vehicle is run at low speed with the vehicle speed V lower than 50 Km/h, the target opening degree $\theta_i$ of the throttle valve 2 is decreased, as a result of which acceleration and deceleration of the vehicle are moderately carried out, with improved drivability.

The arithmetic and control section 20 applies the rotation instruction signals $D_1$ and $D_2$ to the electronic control actuators 8 and 9 so that the difference between the target opening degree $\theta_i$ of the throttle valve 2 calculated according to the above-described expression and the output signal $\theta$ of the opening degree sensor 17 of the throttle valve is zeroed. The contents of the instruction signals $D_1$ and $D_2$ are direction of rotation, energization (rotation), deenergization (stop) and braking depending on the operation modes of the respective drive motors. In the throttle valve control device of the invention, the operation of the throttle valve 2 can be controlled as long as at least one of the electronic control actuators 8 and 9 is operated satisfactorily. When both of the electronic control actuators are operated, the throttle valve is operated quickly: the responsibility is about twice as high as that in the case where only one actuator is in operation.

As was described above, in the throttle valve control device according to the invention, the valve shaft for driving the throttle valve is driven through the differential gear device, the two drive gears of the differential gear device are rotated by the two electronic control actuators including the drive motors, respectively, and the operation of the throttle valve is controlled with the two electronic control actuators while the degree of opening of the throttle valve is being detected. Therefore, the throttle valve control device is high in reliability, low in manufacturing cost, and high in responsibility.

What is claimed is:

1. A throttle valve control device comprising:

a valve shaft for operating a throttle valve adapted to vary the output of an engine;

a differential gear device for driving said valve shaft, said differential gear device having first and second drive gears;

first and second electronic control actuators for rotating said first and second drive gears of said differential gear device, respectively; and an opening degree sensor for detecting a degree of opening of said throttle valve.

2. A throttle valve control device as claimed in claim 1, which further comprises first and second drive means through which said first and second gears are rotated by said first and second electronic control actuators, said first and second drive means each having a worm and a worm wheel.

* * * * *